US006125242A

United States Patent [19]

Yamada

[11] Patent Number: 6,125,242

[45] Date of Patent: Sep. 26, 2000

[54] IMAGE FORMING METHOD THAT SWITCHES FROM AN EMPTY PAPER CASSETTE TO A NON-EMPTY PAPER CASSETTE

[75] Inventor: Ayako Yamada, Kanagawa-ken, Japan

[73] Assignee: Kabushiki Kaisha Toshiba, Kawasaki, Japan

[21] Appl. No.: 09/392,642

[22] Filed: Sep. 9, 1999

Related U.S. Application Data

[62] Division of application No. 09/005,831, Jan. 12, 1998.

[30] Foreign Application Priority Data

Jan. 22, 1997 [JP] Japan ..... 9-009776

[51] Int. Cl.[7] ..... G03G 15/00

[52] U.S. Cl. ..... 399/23; 399/85

[58] Field of Search ..... 399/23, 46, 391, 399/392, 393, 85; 271/902, 903; 347/262

[56] References Cited

U.S. PATENT DOCUMENTS

| | | | |
|---|---|---|---|
| 4,008,957 | 2/1977 | Summers | 355/14 |
| 4,265,440 | 5/1981 | Shibazaki et al. | 271/9 |
| 4,639,114 | 1/1987 | Ide et al. | 355/35 |
| 4,763,889 | 8/1988 | Dei et al. | 271/9 |
| 4,786,920 | 11/1988 | Igarashi | 346/134 |
| 5,028,041 | 7/1991 | Kobayashi | 271/9 |
| 5,029,833 | 7/1991 | Tani et al. | 271/9 |
| 5,061,958 | 10/1991 | Bunker et al. | 355/209 |
| 5,168,316 | 12/1992 | Hino et al. | 355/309 |
| 5,195,734 | 3/1993 | Tanabe | 271/9 |
| 5,435,536 | 7/1995 | Adachi et al. | 271/9.03 |
| 5,523,822 | 6/1996 | Tsuda | 355/208 |
| 5,624,108 | 4/1997 | Kubo | 271/9.12 |
| 5,648,812 | 7/1997 | Igarashi | 347/262 |
| 5,742,327 | 4/1998 | Igarashi | 347/262 |

*Primary Examiner*—Quana Grainger
*Attorney, Agent, or Firm*—Foley & Lardner

[57] ABSTRACT

An image forming apparatus includes plural paper feed portions to feed paper and an image forming portion to form an image on paper fed from one of the plural feed portions. When paper in the paper feed portion which feeds paper on which the image is formed in the image forming portion of this image forming apparatus is exhausted, it is so controlled that paper is automatically fed to the image forming portion from another paper feed portion containing the same size paper as that contained in the current paper feed portion, enabling it to continue the image forming operation and it is possible to set whether the execution of the automatic paper feed control is permitted or prohibited for each of plural paper feed portions.

9 Claims, 7 Drawing Sheets

FIG. 5

| ADJUSTING CODE | DESCRIPTION |
|---|---|
| CODE 21 | 0: PROHIBIT THE AUTO CASSETTE CHANGE FUNCTION<br>1: PERMIT THE AUTO CASSETTE CHANGE FUNCTION |
| CODE 148 | 0: NO AUTO JUDGMENT ON OK/NO FOR THE AUTO CASSETTE CHANGE FUNCTION<br>1: AUTO JUDGEMENT AVAILABLE ON OK/NO FOR THE AUTO CASSETTE CHANGE FUNCTION |
| CODE 149 | 0: NO SELECTION OF OK/NO FOR THE AUTO CASSETTE CHANGE FUNCTION BY MESSAGE<br>1: SELECTION OF OK/NO FOR THE AUTO CASSETTE CHANGE FUNCTION BY MESSAGE |
| CODE 150 | 0: PERMIT THE AUTO CASSETTE CHANGE FUNCTION FROM/TO THE MANUAL PAPER FEED<br>1: PROHIBIT THE AUTO CASSETTE CHANGE FUNCTION FROM/TO THE MANUAL PAPER FEED |
| CODE 151 | 0: PERMIT THE AUTO CASSETTE CHANGE FUNCTION FROM/TO THE LARGE CAPACITY PAPER FEED MEANS<br>1: PROHIBIT THE AUTO CASSETTE CHANGE FUNCTION FROM/TO THE LARGE CAPACITY PAPER FEED MEANS |
| CODE 152 | 0: PERMIT THE AUTO CASSETTE CHANGE FUNCTION FROM/TO THE FOURTH PAPER CASSETTE<br>1: PROHIBIT THE AUTO CASSETTE CHANGE FUNCTION FROM/TO THE FOURTH PAPER CASSETTE |
| | |
| CODE 154 | 0: PERMIT THE AUTO CASSETTE CHANGE FUNCTION FROM/TO THE FIRST PAPER CASSETTE<br>1: PROHIBIT THE AUTO CASSETTE CHANGE FUNCTION FROM/TO THE FIRST PAPER CASSETTE |
| CODE 155 | 0: PERMIT THE AUTO CASSETTE CHANGE FUNCTION FROM/TO THE SECOND PAPER CASSETTE<br>1: PROHIBIT THE AUTO CASSETTE CHANGE FUNCTION FROM/TO THE SECOND PAPER CASSETTE |
| CODE 156 | 0: PERMIT THE AUTO CASSETTE CHANGE FUNCTION FROM/TO THE THIRD PAPER CASSETTE<br>1: PROHIBIT THE AUTO CASSETTE CHANGE FUNCTION FROM/TO THE THIRD PAPER CASSETTE |

IMAGE FORMING METHOD THAT SWITCHES FROM AN EMPTY PAPER CASSETTE TO A NON-EMPTY PAPER CASSETTE

This application is a divisional of application Ser. No. 09/005,831, filed Jan. 12, 1998.

BACKGROUND OF THE INVENTION

1. Field of the Invention

The present invention relates to an image forming apparatus equipped with a plurality of paper feeding means, for instance, paper cassettes containing plural sheets of paper and a function to automatically change over a paper cassette to another one containing paper in the same size when the paper in the paper cassette is exhausted during the copying operation so as to be able to continue the copying operation and an image forming method.

2. Description of the Related Art

Image forming apparatus such as a copying machine, etc. to reproduce images based on digital data will converts an image obtained by reading an original document through an optical means into electric signals. Image data are obtained by applying various image processes to these electric signals and the image data thus obtained are accumulated in a memory or processed. Based on these image data, an image is reproduced on an image forming medium using an electrophotographic process while applying a laser beam.

In a prior art, there is an automatic paper cassette change function to automatically change over a paper cassette to another paper cassette when sheets of paper contained in the paper cassette are exhausted during the image reproduction so as to continue the copying operation. There are codes for adjusting the YES or NO of this automatic cassette change function. These adjusting codes can be set by a serviceman.

However, the YES or NO of the automatic paper cassette change function could be set only by a serviceman and was not possible by user or a menu.

Also, it was not possible to change over the automatic paper cassette change function for each paper cassette, for instance, to select only the NO of the automatic cassette change from the manual paper feeding. In particular, for the manual paper feeding by setting plural sheets of paper on a manual paper feed guide, special paper such as thick paper, color paper, etc. are often used. Accordingly, if paper is exhausted during the copying, the automatic paper cassette change function works and the cassette is changed over to another paper cassette provided in the main body of a copying machine, the copying continues on a different kind paper and an image will not be copied on a desired paper.

As described above, in the automatic cassette change function to continue the copying by automatically changing the cassette to another paper cassette containing the same size paper when the paper set in a manual paper feed guide or in the cassette currently feeding paper is exhausted during the copying operation, the YES or NO of this automatic cassette change function was effected only by setting adjusting codes by a serviceman. Accordingly, user was not able to set the YES or NO of the automatic cassette change function for each paper feed cassette and further, this function also could not be set by user or a menu. For instance, in the manual paper feeding, such special paper as thick paper and colored paper are often used and if paper is exhausted during the copying, the automatic cassette change function is actuated and a paper cassette is changed and different kind of paper is copied. In other words, the automatic cassette change function cannot be used effectively, for instance, the copying is made on other kinds of paper that are not desired.

SUMMARY OF THE INVENTION

It is an object of the present invention to provide an image forming apparatus and an image forming method that are capable of setting the YES or NO of an automatic paper cassette change function for each paper cassette and also, enabling user to select the YES or NO of the automatic paper cassette change function and using the automatic paper cassette change function effectively, and to provide an image forming method.

According to the present invention, an image forming apparatus is provided. This image forming apparatus comprises plural paper feed means for feeding paper; means for forming images on the paper fed from one of the plural paper feed means; automatic paper feed control means for controlling the paper feed means so that if paper contained in a paper feed means that is feeding paper for forming images by the image forming apparatus is exhausted, the same size paper contained in another paper feed means as that paper contained in the current paper feed means is fed to continue the image forming operation; and means for setting the YES or NO for executing the automatic paper feed control means for each of the plural paper feed means.

Further, according to the present invention, an image forming method in an image forming apparatus having plural paper feeding means to feed paper is provided. This image forming method comprises the steps of forming an image on a paper fed from one of the plural paper feed means; controlling the paper feed to continue the image forming operation by automatically feeding paper from another paper feed means containing the same size paper as the paper contained in the current paper feed means when the paper contained in this paper feed means to feed paper for the image formation in the image forming step is exhausted; and setting the YES or NO to execute the automatic paper feed control step for each of the plural paper feed means.

BRIEF DESCRIPTION OF THE DRAWINGS

FIG. 5 is a table showing adjusting modes of an automatic paper cassette change mechanism;

DETAILED DESCRIPTION OF THE PREFERRED EMBODIMENTS

Hereinafter, an embodiment of the present invention will be described with reference to the attached drawings.

Figure 1:
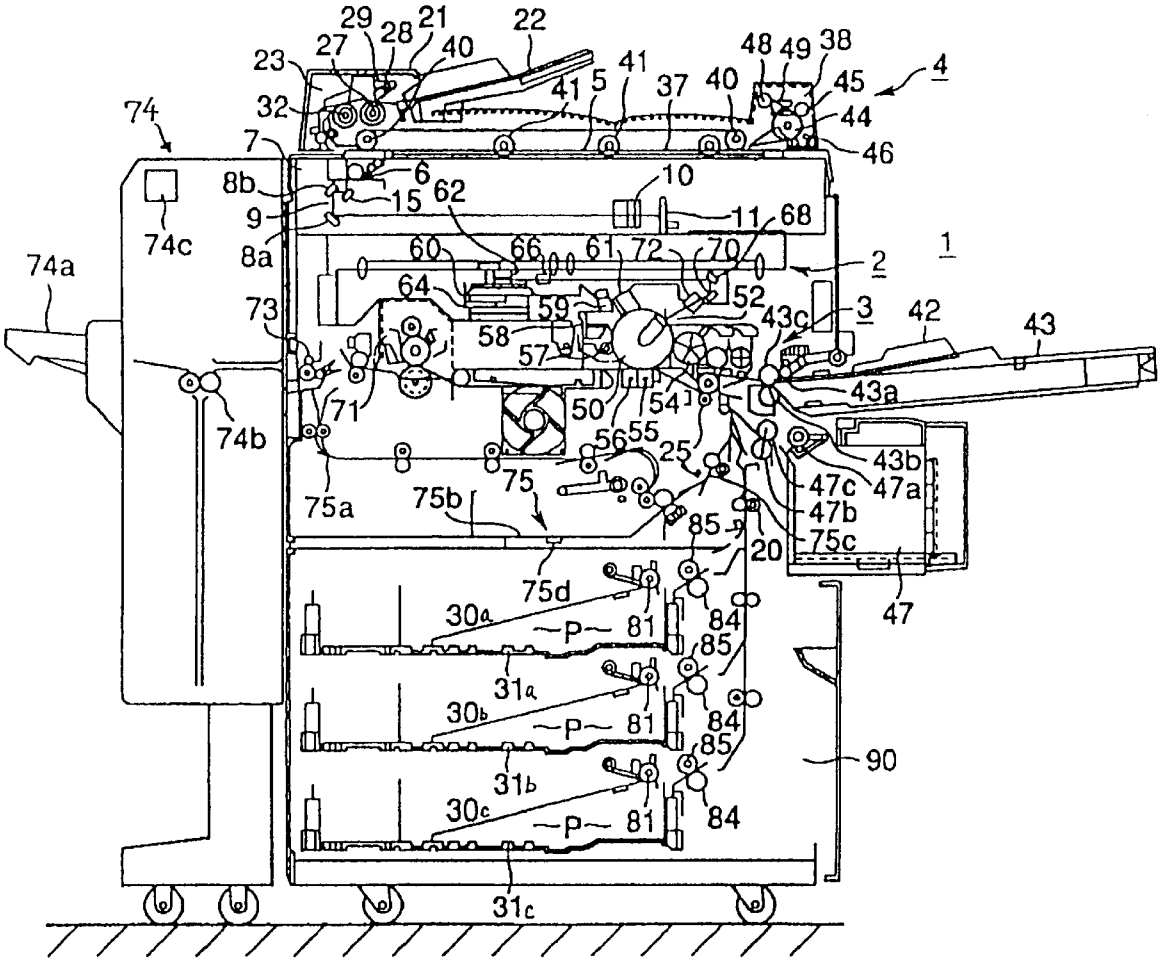
FIG. 1 is a schematic sectional view of a copying machine of an image forming apparatus of the present invention.

FIG. 1 is a diagram schematically showing the entire construction of a copying machine using digital data, which is an image forming apparatus of the present invention. A main body 1 of this copying machine is equipped with a scanner 2 and a printer 3, and an automatic document feeder 4 is mounted on the top.

The automatic document feeder 4 has a cover unit 21. The rear edge of this cover unit 21 is mounted at the rear edge of the top of the main body 1 of the copying machine by a hinge unit (not shown). Accordingly, it is so constructed that the top of the document table 5 can be opened by rotating the entire automatic document feeder 4 as necessary. On the top of the cover unit 21, a document feed table 22 that is capable of collectively holding plural documents. At one end of the cover unit 21, a feeder unit 23 is provided to take out documents one by one and feed to the left end side of the document table 5. The feeder unit 23 is provided with a pick-up roller 27 to take out documents, a weight plate 28 to push a document against the pick-up roller 27 and an empty sensor 29 that is a document sensor to sense the set state of documents on the document feed table 22. In addition, there is a document feed roller 32 arranged in the document take out direction of the pick-up roller 27 so that documents can be certainly fed by one sheet at a time. On the top of the document table 5, a document conveyer belt 37 is put and stretched to cover it. The document conveyer belt 37 is composed of an endless belt having a wide white outer surface and put over a pair of belt drive rollers 40 and 40. The document conveyer belt 37 is run in both the forward and reverse directions by a belt driving mechanism (not shown). On the back side of the inner surface of the document conveyer belt 37, there are provided plural belt press rollers 41 to press the belt surface down to the document table 5 and a set switch (not shown) to detect the closing/opening state of the automatic document feeder 4. A document fed by the feeder unit 23 is conveyed from the left end side to the right end side of the document table 5. There is a document discharge unit 38 provided at the right side of the cover unit 21. This document discharge unit 38 is composed of a conveyer roller 44, a pinch roller 45 to press a document against this conveyer roller 44 and a paper discharge sensor 46 that is a document sensing means to sense the trailing edge of a document fed in the paper discharge direction. At the downstream side of the document discharge path, a paper discharge roller 48 is provided. Further, there is a gate 49 provided in the document discharge path to turn the outside of a document in and lead it to the document table 5 again. So, both sides of a document can be copied.

The scanner 2 is composed of the exposure lamp 6, the first carriage 7 equipped with a mirror 15, a second carriage 9 equipped with mirrors 8*a* and 8*b* to bend the optical path, a lens 10, a CCD sensor 11 to receive the reflected light and an A/D converter (not shown) to covert the output of the CCD sensor, that is, image data from analog data to digital data. The first and second carriages 7 and 9 are connected each other by a timing belt (not shown) and the second carriage 9 moves at ½ speed of the first carriage in the same direction. As a result, it becomes possible to scan so that the optical path length up to the lens 10 becomes uniform. The lens 10 has a fixed focal distance and is moved in the direction of optical axis when a magnification is changed. One pixel of a document is corresponding to one element of the CCD sensor 11. The output of the CCD sensor 11 is output to the A/D converter. The first and second carriages 7 and 9 and the mirrors 8*a*, 8*b* and 15 are moved by a stepping motor (not shown). The first and second carriages 7 and 9 are moved according to the movement of a timing belt put over a drive pulley (not shown) and an idle pulley (not shown) which are connected to the rotary shaft of the stepping motor. The lens 10 is moved to the direction of the optical axis by the movement of a spiral shaft (not shown) which is rotated by the stepping motor (not shown).

A reference numeral 60 denotes a laser diode and corresponding to the laser diode 60, a collimator lens 62, a polygon mirror 64, a lens 66, reflectors 68, 70 and 72 are arranged and laser beam is applied to a photosensitive drum 50 via an exposure unit 52.

The printer 3, that is an image forming means, combines, for instance, a laser optical system with an electrophotographic system that is capable of forming an image on a transfer paper. That is, the printer 3 has the photosensitive drum 50 as an image carrier supported rotatably at almost the center in the main body 1. There are the exposure unit 52, a developing device 54, a transfer charger 55, a separation charger 56, a charge eliminator 57, a cleaner 58, a charge elimination lamp 59 and a main charger 61 are arranged in order around the photosensitive drum 50. The photosensitive drum 50 is uniformly charged by the main charger 61 and the laser beam that is output from the scanner 2 is applied to the photosensitive drum 50 and an electrostatic latent image corresponding to a document is formed thereon.

The electrostatic latent image formed on the photosensitive drum 50 is developed by the developing device 54 and a developer image is obtained. This developer image is transferred by the action of the transfer charger on a paper P that is fed from, for instance, a first paper cassette 30*a* out of plural paper feed means by way of a paper feed roller 20 and an aligning roller 25. The paper P carrying the transferred developer image is separated by the action of AC corona discharge of the separation charger 56 and conveyed to a fixer 71 by way of the conveyer belt. The developer image on the paper P conveyed to the fixer 71 is fused and fixed on the paper P. The paper P carrying the fixed developer image is discharged by an exit roller pair 73 to an additional unit 74 having a paper receiving tray 74*a*. The additional unit 74 has a roller pair 74*b* that faces down the paper P exit from the exit roller pair 73. Further, the additional unit 74 has a stapler 74*c* on its top to staple plural sheets of paper by one copy in the staple sort mode.

After transferring a developer to and separating a paper P, the developer left on the photosensitive drum 50 is cleaned by the cleaner 58 after eliminating charge by the charge eliminator. In addition, potential on the photosensitive drum 50 is reduced to below a certain level by the charge elimination lamp 59, thus enabling the next image forming operation.

Further, in case of the duplex copying to print both sides of a paper P, the paper P carrying the developed image fused and fixed by the fixer 71 is accumulated in the tray 75*b*. The one side printed paper P accumulated in this tray 75*b* is conveyed to the transfer charger 55 again by way of the conveying path 75*c* and a developer image is transferred on the unprinted another side. Further, under the tray 75*b*, a light reflecting type paper sensor 75*d* is provided to sense the presence of paper stacked on the tray 75*b*.

An automatic duplex device 75 which is an automatic duplex reversing mechanism is composed of the conveying path 75*a*, the tray 75*b*, the conveying path 75*c* and the paper sensor 75*d*. A paper feed pedestal 90 is composed of a first, second and third paper cassettes 30*a*, 30*b* and 30*c*, which are paper feeding means mounted at the upper, middle and lower stages detachably from the front side of the main body 1 of the copying machine. These first, second and third paper cassettes 30*a*, 30*b* and 30*c* are composed of a first, second and third cassette cases 31*a*, 31*b* and 31*c* containing paper P. The take-out ends of these first, second and third cassette cases 31*a*, 31*b* and 31*c* are tilted in the paper take-out direction. Paper P contained in the first, second and third cassette cases 31*a*, 31*b* and 31*c* are taken out by a pick-up roller 81 provided to each of them. Paper P taken out by the pick-up roller 81 corresponding to, for instance, the first cassette case 31*a* are separated to each sheet in a paper separating unit comprising a paper feed roller 84 and a separation roller 85 provided at the upper part in the inside of the take-out end of this first cassette case 31*a* and conveyed to the printer 3. Similarly, paper P taken out of the second and third cassette cases 31*b* and 31*c* are also conveyed to the printer 3.

As other paper feeding means, the manual paper feed guide 42 that is a manual paper feeding means, the paper cassette 43 that is detachably mounted and a large capacity cassette 47 are provided at the right side of the main body 1. Paper P contained in the paper feed cassette 43 is taken out by the pick-up roller 43*a*. The paper P taken out by the pick-up roller 43*a* are separated to each sheet in a paper separating unit comprising the paper feed roller 43*b* and the separation roller 43*c* provided at the upper part in the inside of the take-out end of the paper feed cassette 43 and conveyed toward the printer 3. Paper P contained in the large capacity cassette 47 are taken out by the pick-up roller 47*a*. The paper P taken out of the large capacity cassette 47 by the pick-up roller 47*a* are separated to each paper in the paper separating unit comprising the paper feed roller 47*b* and the separation roller 47*c* provided at the upper part in the inside of the take-out end of the large capacity cassette 47 and are conveyed toward the printer 3.

Figure 2:
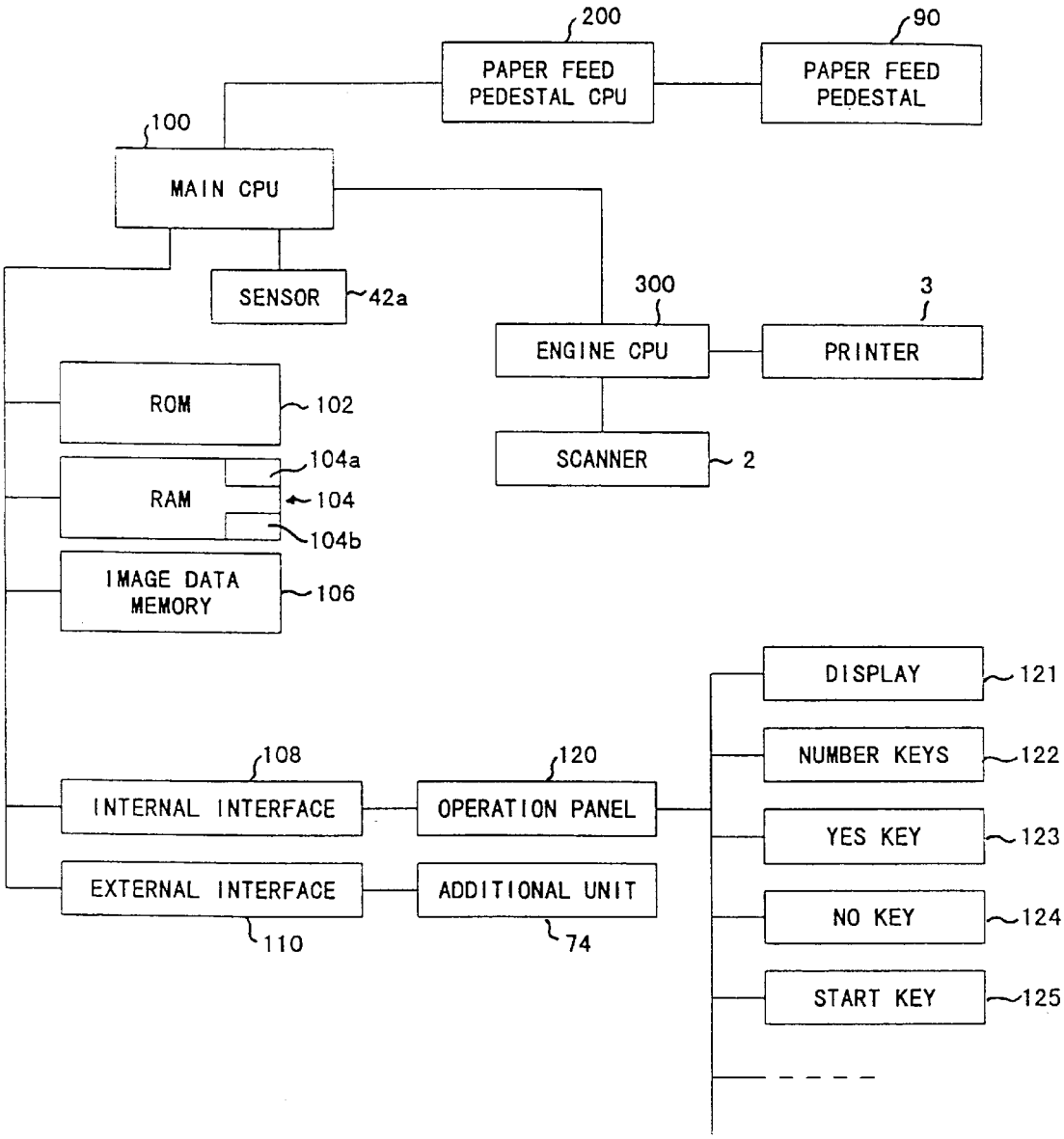
FIG. 2 is a block diagram showing the construction of a control system of the copying machine shown in FIG. 1.

FIG. 2 shows the construction of a control system that is used in a copying machine of this embodiment. A main CPU 100 that controls the entirety of the copying machine is connected with a ROM 102, a RAM 104, an image memory 106, an internal interface 108 and an external interface 110.

Although the details will be described later, code data are stored in a nonvolatile memory portion 104*a* in the RAM 104 that is a storage means and data on the OK/NO for the automatic cassette change function are stored in a volatile memory portion 104*b*.

An operation panel 120 is connected to the internal interface 108 and the additional unit 74 is connected to the external interface 110. There are a display 121, a number key 122, a YES key 123, a NO key 124 and a start key 125 arranged on the operation panel 120.

The main CPU 100 is connected with a paper feed pedestal CPU 200, an engine CPU 300 and the sensor 42*a*. The paper feed pedestal CPU 200 controls the paper feed pedestal 90. The engine CPU 300 controls the scanner 2 and the printer 3. The sensor 42*a* is a manual paper feed sensing means to sense the manual insertion of paper from the manual paper feed guide 42.

When performing the automatic cassette change, cassette information is sent to the paper feed pedestal CPU 200 from the main CPU 100 and the paper cassette is changed over in the paper feed pedestal 90.

Figure 3:
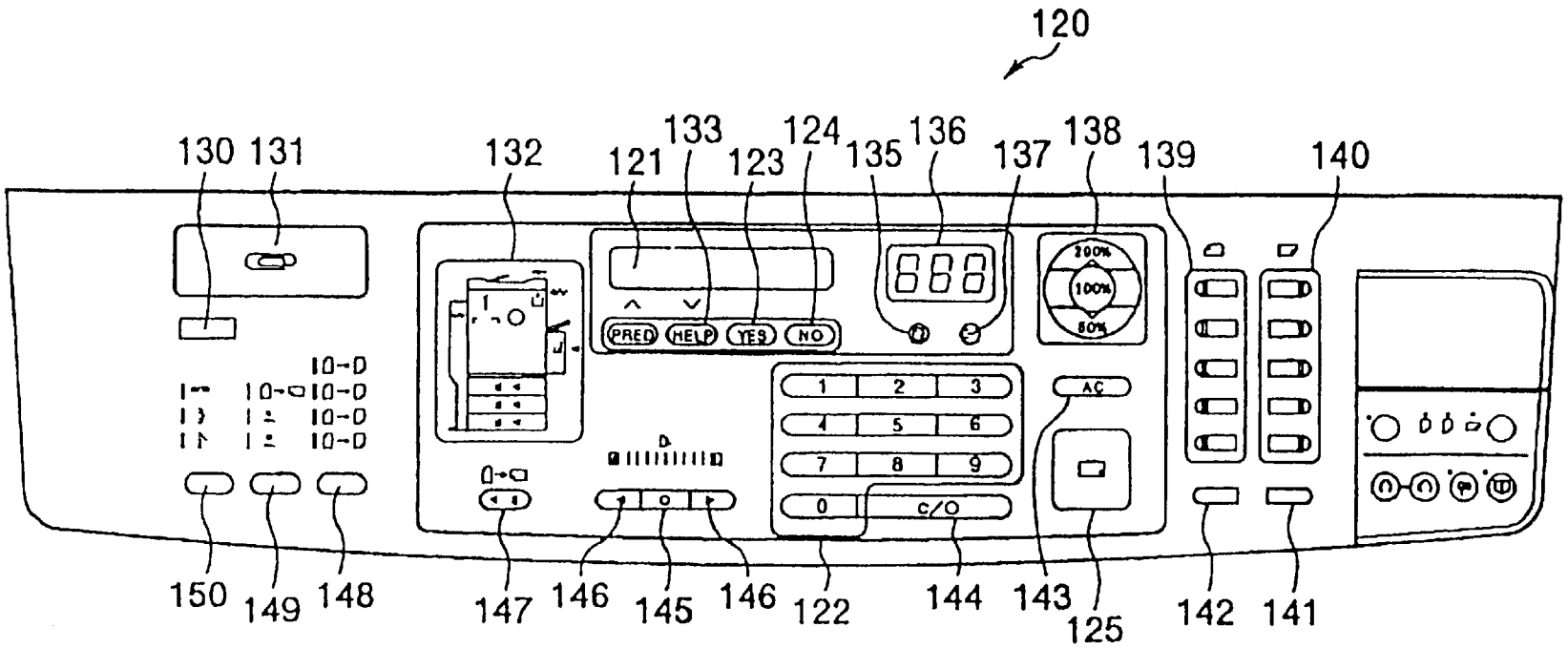
FIG. 3 is a plan view showing the construction of a operation panel provided on the copying machine shown in FIG. 1.

FIG. 3 shows the construction of the operation panel 120 which is an input means. On the control panel 120, a finisher key 130, a clip receiver 131, a display panel 132, a HELP key 133, a pre-heat key 135, a numeric display 136, an interrupt key 137, a zoom/100% key 138, a document size selection key 139, a paper size selection key 140, an automatic paper size selection key 141, an automatic magnification selection key 142, an all clear key 143, a clear/stop key 144, an automatic density control key 145, a pair of manual density control keys 146, a cassette selection key 147, a duplex copy selection key 148, a binding margin selection key 149 and a sorter key 150 are arranged in addition to the display key 121, the number key 122, the YES key 123, the NO key 124 and the start key 125.

On the display 121 as the display means, the state of the main body 1 of the copying machine, the operating steps and various directions for user are displayed by characters and pictures.

The number key 122 is used to set the number of sheets desirable for copying. The number of copies can be set from 1 up to 999 sheets.

The selection of YES/NO of the automatic cassette change is made by depressing the YES key 123 or the NO key 124 which is an direction means. For instance, when the YES key 123 or the NO key 124 is depressed after a message "Make the automatic cassette change from the currently selected paper cassette?" is displayed on the display 121, the YES or NO for the execution of the function is selected.

The start key 125 is pushed when starting the copying. The finisher key 130 is used to select the sort mode, group mode or staple mode.

The clip receiver 131 is provided with a magnet to place a clip removed from a document to be copied.

On the display panel 132, various icons are displayed, and flicker to show the state of the copying machine.

When the HELP key 133 is depressed as the operating guide, a message showing the operating steps is displayed on the display 121 and when it is depressed after setting the function, the set contents can be checked.

When the pre-heat key 135 is depressed, the main body 1 is put in the pre-heat (power saving) state and all display lamps go out. When this pre-heat key is depressed again, the copying machine becomes the state ready to start the copying.

The numeric display 136 displays the number of copies that is set by the number key.

The interrupt key 137 is used to take a copy (or copies) by interrupting the continuous copying operation.

When the "50%" key of the zoom/100% key 138 is depressed, the copying magnification becomes small down to 50% at the step of 1%. When the "200%" key is depressed, the copying magnification becomes large up to 200% at the step of 1%. When the "100%" key is depressed, the magnification returns to the equal magnification (100%).

The document size selection key 139 is used to set a document size. When a user selects a paper size and designates a document size, the copying magnification is automatically set.

The paper size selection key 140 is used when a user selects a paper size.

The automatic paper size selection key 141 is normally set in the automatic paper selection mode. A size of a document placed on the document table 5 is automatically sensed and the same size paper is automatically selected (only for the equal magnification copying).

When the automatic magnification selection key 142 is depressed to select the automatic magnification selection mode and a desired paper size is designated, a size of a document placed on the document table 5 is sensed and a copying magnification is automatically computed.

When the all clear key 143 is depressed, the selected modes are all cleared and the standard state is restored.

The clear/stop key 144 is used to correct the number of sheets to be copied or to stop the copying operation.

When the automatic density control key 145 is depressed, the copying machine senses the density of a document and selects the optimum copying density.

User is able to select a desired copying density by the manual density control key 146. Density can be made thin in 5 stages by depressing the "THIN" key and thick in 5 stages by depressing the "THICK" key.

If a selected paper cassette is not in a desired size, user is able to select another cassette by depressing the cassette selection key 147.

The duplex copy selection key 148 is used to take a duplex copy from a single side document, a duplex copy from a duplex document, a single side copy from a duplex document or a duplex copy from a book document.

The binding margin selection key 149 is used to provide a binding margin on a copied paper.

The sorter key 150 is used to select the sort mode, group mode or staple mode.

Figure 4:
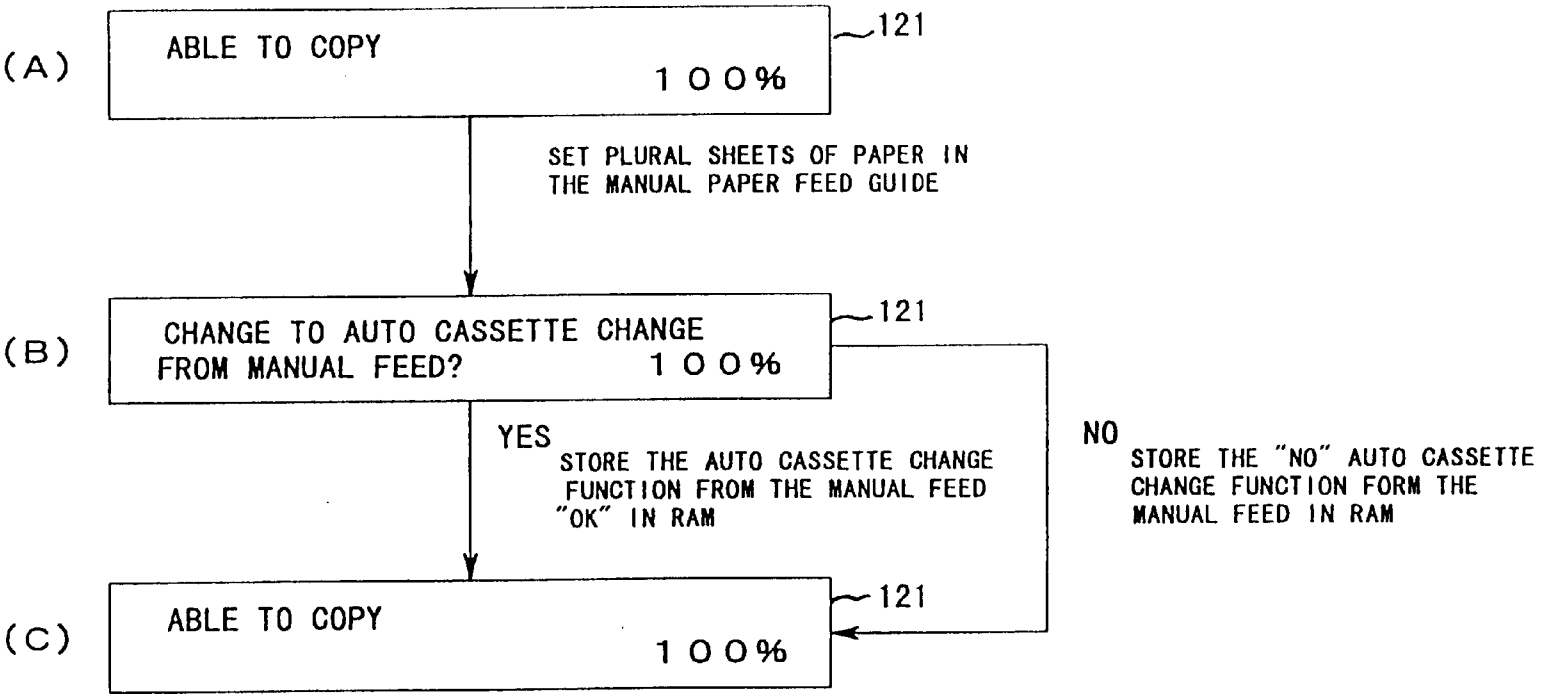
FIG. 4 is a flowchart for explaining the selecting operation of the OK/NO of the automatic paper cassette change function when setting paper on a manual paper feed guide.

FIG. 4 shows examples of the displays shown on the display 121 on the operation panel 120 when setting paper on the manual paper feed guide 42.

FIG. 4(A) shows the display of the copy waiting state on the display 121 and a message "ABLE TO COPY" is displayed. Here, when plural sheets of paper are set on the manual paper feed guide 42, the main CPU 100 senses this paper via the sensor (the manual paper sensing means) 42*a* and displays a message "CHANGE TO AUTO CASSETTE CHANGE FROM MANUAL FEED?" on the display 121 as shown in FIG. 4(B).

By depressing the YES key 123 or the NO key 124, user is able to select the OK or NO for the execution of the automatic cassette change function from the manual paper feeding. When the YES key 123 is depressed, the automatic cassette change function is executed and when the NO key 124 is depressed, the automatic cassette change function is not executed.

Thus, when the YES key 123 or the NO key 124 is depressed, the main CPU 100 displays the message "ABLE TO COPY" as shown in FIG. 4(C). The received information by the YES key 123 and the NO key 124 are stored as the YES or NO of the automatic cassette change function for each paper cassette in the volatile memory portion 104*b* in the RAM 104.

For instance, the main CPU 100 executes the copy operation after making the above selection. If paper is exhausted while executing the copy operation, the main CPU 100 checks the received information of the YES key 123 or the NO key 124 stored in the volatile memory portion 104*b* in the RAM 104. If the received information of the YES key 123 is that the automatic cassette change function is "OK", the CPU 100 controls the operation so as to change over to feed paper from a paper cassette containing paper in the same size as the paper before exhausted. If the received information of the NO key 124 is that the automatic cassette change function is "NO", the CPU 100 controls so as to display a message showing the exhaust of paper on the display 121.

FIG. 5 shows adjusting modes of the automatic cassette change mechanism that is an automatic paper feed control means. That is, a serviceman is able to select OK or NO for the execution of the automatic cassette change function by directly setting the adjusting codes shown in FIG. 5 through the operation panel 120 by using it as a setting means likewise the selection by user according to the message as described above. The NO or YES of the automatic cassette change function by a serviceman is stored in the nonvolatile memory portion 104*a* in the RAM 104 by inputting adjusting modes by a serviceman through the operation panel in the adjusting mode. This adjusting mode is not limited to the manual feed but is applicable to all paper cassettes as shown in FIG. 5 and the setting state is stored in the codes 151 through 156 likewise the manual paper feeding.

In the adjusting code 150, the YES or NO of the automatic cassette change function from/to the manual feed is set and the setting state is stored. The set value "0" is the YES and "1" is the NO.

In the adjusting code 151, the YES or NO of the automatic cassette change function from/to the large capacity cassette 47 is set and the setting state is stored.

In the adjusting code 152, the YES or NO of the automatic cassette change function from/to the fourth paper cassette at the upper state of the main body is set and the setting state is stored.

In the adjusting code 154, the YES or NO of the automatic cassette change function from/to the first paper cassette 30*a* at the upper stage of the paper feed pedestal 90 is set and the setting state is stored.

In the adjusting code 155, the YES or NO of the automatic cassette change function from/to the second paper cassette 30*b* at the middle stage of the paper feed pedestal 90 is set and the setting state is stored.

In the adjusting code 156, the YES or NO of the automatic cassette change function from/to the third paper cassette 30*c* at the lower stage of the paper feed pedestal 90 is set and the setting state is stored.

Further, the adjusting code 153 is used when the fourth paper cassette is provided at the lower stage but is omitted here as it is not provided in the copying machine shown in FIG. 1.

The selection or non-selection of the automatic cassette change function according to a message displayed on the display 121 shown in FIG. 4 is also set and stored under the adjusting code 149. For instance, the data of the code 149 is "0", it denotes "Non-Selection" and even when paper is set in the manual paper feed guide 42, the message "CHANGE TO AUTO CASSETTE CHANGE FROM MANUAL FEED?" shown in FIG. 4(B) is not displayed.

Further, in the adjusting code 21, the "0" for NO or the "1" for YES of the automatic cassette change function is set and stored.

In the adjusting code 148, "0" for no automatic judgment as to the YES or the NO of the automatic cassette change function and "1" for the automatic judgment are set and stored.

Figure 6:
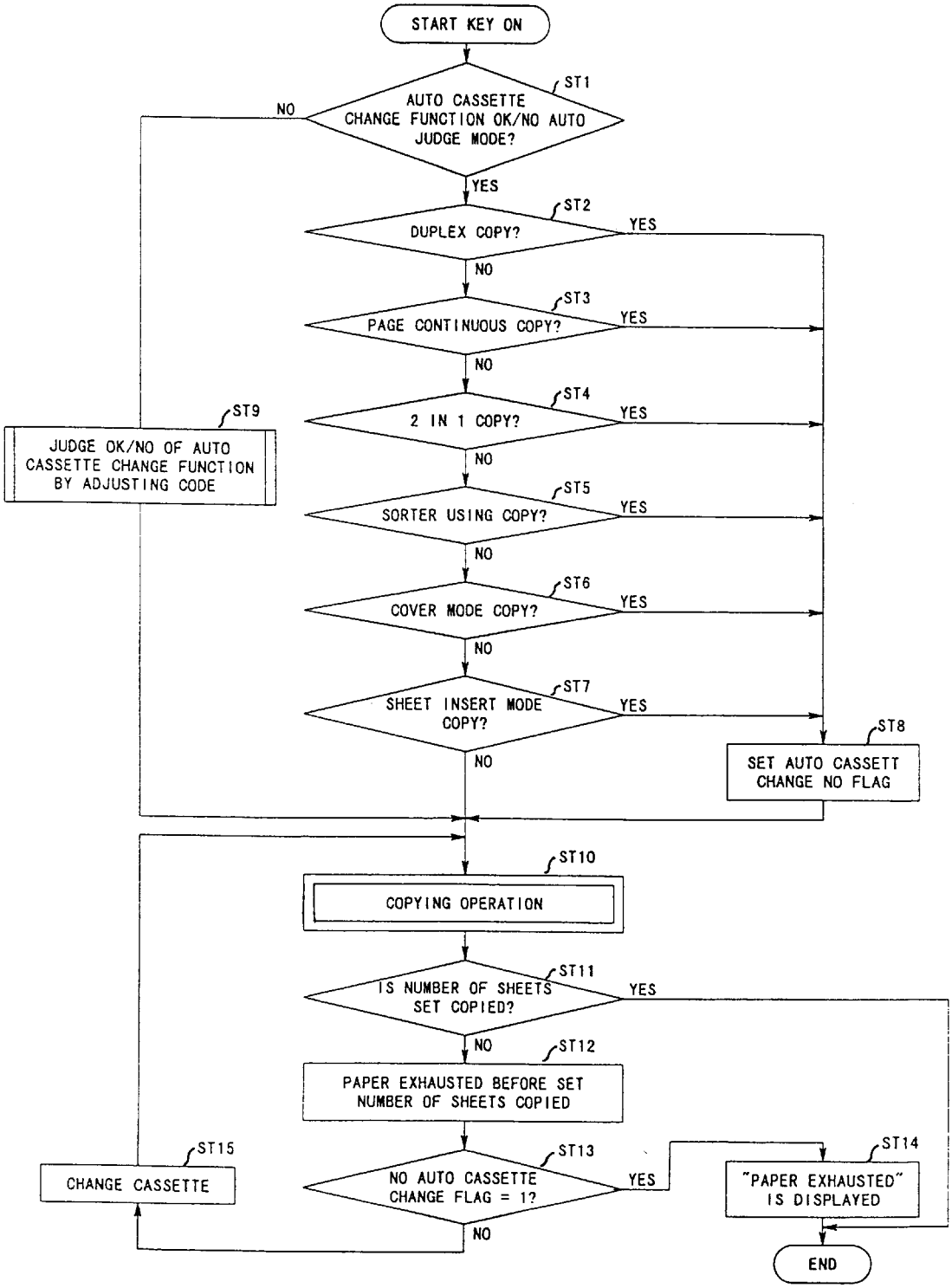
FIG. 6 is a flowchart for explaining the copying operation of the copying machine.
Figure 7:
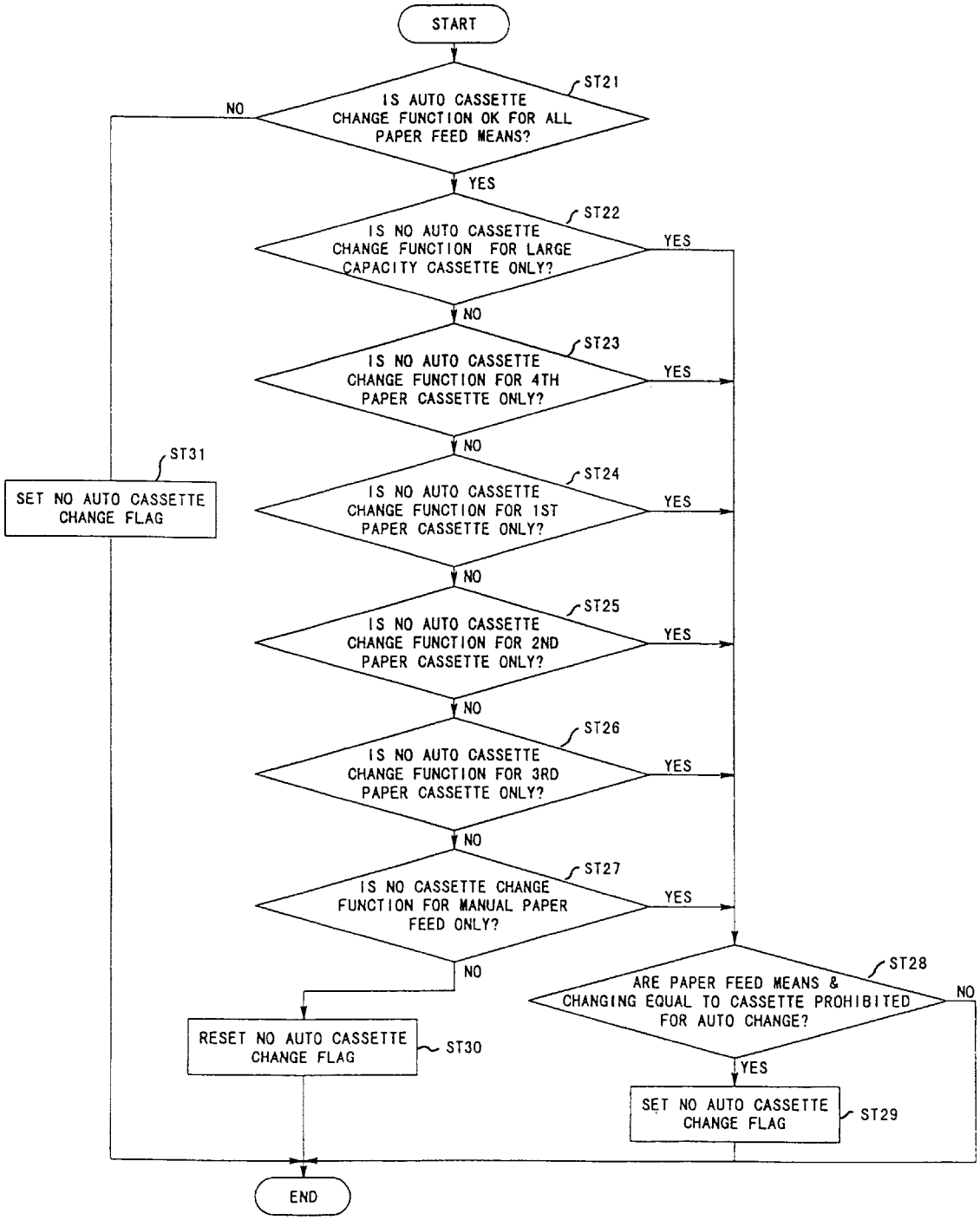
FIG. 7 is a flowchart for explaining the operation to judge the OK/NO of the automatic paper cassette change function by the adjusting codes in the flowchart shown in FIG. 6.

Next, the copying operation of the copying machine in such construction will be described referring to the flowcharts shown in FIG. 6 and FIG. 7.

After various settings are made through the operation panel 120 and the start key 125 is depressed to start the copying operation, the main CPU 100 first judges if it is the automatic judging mode for OK/NO of the automatic cassette change function by checking a value of the adjusting code 148 stored in the nonvolatile memory portion 104*a* in the RAM 104 (ST1).

If it is the automatic judging mode (the adjusting code 148=1), the main CPU 100 checks if the copy is the duplex copy (ST2), continuous page copy (ST3), 2 in 1 copy (ST4), sorter using copy (ST5), cover mode copy (ST6) or sheet insert mode copy (ST7) and the mode is one of the above modes, sets an automatic cassette change function NO flag in the volatile memory portion 104*b* in the RAM 104 (ST8). The "Continuous Page Copy" in Step ST3 is the mode to continuously copy both pages put on the document table 5 by opening both pages of a book to be copied. The "2 in 1 Copy" in Step ST4 is the mode to simultaneously copy corresponding images in two sheets of a document on a one side of a sheet of paper. The "Cover Mode Copy" in Step ST6 is the mode wherein two paper cassettes or one manual paper feed means and one paper cassette in the same size are prepared and one of them is special paper such as thick paper for a cover and a document equivalent to a cover is copied on a special paper. The "Sheet Insert Mode Copy" in Step ST7 is the mode wherein two paper cassettes or one manual paper feed cassette and one paper cassette in the same size are prepared and one of them is special paper such as color sheet for inverting and documents desired to insert separately from many other white sheets are copied on special paper.

When this NO flag is set, the main CPU 100 does not change over the paper cassette even when paper is exhausted, displays a message demanding paper feed on the display 121 and stops the main body 1 of the copying machine. When this NO flag is reset, the main CPU 100 searches a paper cassette containing the same size paper as the exhausted paper and if available, use that paper cassette for the next paper cassette.

In the above mode, although it is considered that there is clearly a problem when a kind of paper is changed by the automatic cassette change function, based on this assumption, an adjusting mode (Code 148) was provided for the automatic judgment on the YES/NO of the automatic cassette change function.

Further, when the NO automatic cassette change function flag is set, the data value becomes "1" and when it is reset, the data value becomes "0".

Further, in Step ST1, if the mode is not the automatic adjusting mode (Adjusting Code 148=0), a process to check the YES/NO of the automatic cassette change function is performed in another adjudging code (ST9).

Here, the operation of Step ST9 will be described with reference to the flowchart shown in FIG. 7.

First, the main CPU 100 judges that all paper cassettes are permitted or prohibited for the automatic change from a value set in the adjusting code 21 stored in the nonvolatile memory portion 104*a* in the RAM 104 (ST21). When permitted in the judgment in Step ST21, from a value set in the adjusting code 151, it is judged if the automatic cassette change is prohibited for the large capacity cassette 47 only (ST22) and if prohibited, proceeds to Step ST28.

When permitted in Step ST22, from a value set in the adjusting code 152 it is judged if the automatic cassette change is prohibited for the fourth paper cassette 43 only (ST23) and if prohibited, proceeds to Step ST28.

When permitted in Step ST23, from a value set in the adjusting code 154, it is judged if the automatic cassette change is prohibited for the first paper cassette 30*a* only of the paper feed pedestal 90 (ST24) and if prohibited, proceeds to Step ST28.

When permitted in Step ST24, from a value set in the adjusting code 155, it is judged if the automatic cassette change is prohibited for the second paper cassette 30*b* only of the paper feed pedestal 90 (ST25) and if prohibited, proceeds to Step ST28.

When permitted in Step ST25, from a value set in the adjusting code 156, it is judged if the automatic cassette change is prohibited for the third paper cassette 30*c* only of the paper feed pedestal 90 (ST26) and if prohibited, proceeds to Step ST28.

When permitted in Step ST26, from a value set in the adjusting code 150, it is judged if the automatic cassette change is prohibited for the paper feed only from the manual paper feed guide 42 (ST27) and if prohibited, proceeds to Step ST28 and if permitted, resets the NO automatic cassette change flag in the volatile memory portion 194 in the RAM 104 (ST30).

In Step ST28, the main CPU 100 judges if a paper feeding means and a paper cassette that is a destination of the cassette change are equal to a cassette that is prohibited for the automatic change and if equal, set the NO automatic cassette change flag in the volatile memory portion 104*b* in the RAM 104 (ST29)

Further, when prohibited in the judgment in Step ST21, the main CPU 100 sets the NO automatic cassette change flag in the volatile memory portion 104*b* in the RAM 104 (ST31).

Now, when Step ST8 or Step ST9 is completed, the main CPU 100 executes the copying operation (ST10) that is set through the operation panel 120 and when the copying of number of set sheets of paper is completed, terminates the copying operation.

Further, when the copying of the number of set sheets of paper is not completed (ST11) and the paper is exhausted in an applicable paper cassette without completing the copy of the number of set sheets (ST12), the main CPU checks if the NO automatic cassette change flag is set in the volatile memory portion 104*b* in the RAM 104 (the data value=1) or is reset (the data value=0) (ST13).

In Step ST13, when the data value is "0", the main CPU 100 changes a cassette (the same paper size) at the paper feed stage (ST15), proceeds to Step ST10 and continues the copying operation. When the data value is "1", the main CPU 100 displays a paper exhausted message on the display 121 (ST14) and terminates the copying operation until paper is replenished to applicable paper feed means.

As described above, according to the embodiment of the present invention, the YES or NO of the automatic cassette change function is selectable for each paper cassette and user is enabled to select the YES/NO of the automatic cassette change function while observing the message display. Further, in the copy mode which is considered requiring no automatic cassette change function, it is possible to prohibit the automatic change function from the manual paper feeding and a large effect is available for reducing erroneous copy of different kinds of paper.

As described above in detail, according to the present invention, it is possible to provide an image forming apparatus and an image forming method capable of setting the YES/NO of the automatic cassette change function for every paper cassette, thus enabling user to select the YES/NO of the automatic cassette change function and efficiently use the automatic cassette change function.

What is claimed is:

1. An image forming method in an image forming apparatus having plural paper feeders for feeding paper, the method comprising:

forming an image on paper fed from one of the plural paper feeders;

setting an image forming mode;

setting an automatic cassette change mode to each of the paper feeders, wherein the automatic cassette change mode is controlling the operation to continue the image forming operation by automatically feeding paper from another paper feeder containing the same size paper as the paper in the current paper feeder when the paper in the current paper feeder for the image formation is exhausted in the image forming step; and prohibiting the automatic cassette change operation in a case when the image forming mode is set to a predetermined image forming mode.

2. The image forming method according to claim 1, wherein the predetermined image forming mode is a duplex copy mode to form images on both sides of a sheet of paper.

3. The image forming method according to claim 1, wherein the predetermined image forming mode is a continuous page copy mode to continuously copy both pages put on a document table by opening both pages of a book to be copied.

4. The image forming method according to claim 1, wherein the predetermined image forming mode is a 2 in 1 copy mode to simultaneously copy corresponding images in two sheets of a document on one side of a sheet of paper.

5. The image forming method according to claim 1, wherein the predetermined image forming mode is a sorter using copy mode to sort sheets of paper copied images thereon.

6. The image forming method according to claim 1, wherein the predetermined image forming mode is a cover mode copy to copy a document equivalent to a cover on a special paper.

7. The image forming method according to claim 6, wherein the special paper is paper thicker than a normal sheet of paper.

8. The image forming method according to claim 1, wherein the predetermined image forming mode is a sheet insert mode copy to copy a document desired to be inserted separately from other sheets of paper on special paper.

9. The image forming method according to claim 8, wherein the other sheets of paper are white sheets of paper, and wherein the special paper are non-white, colored sheets of paper.

* * * * *